United States Patent [19]

Schnitzler

[11] Patent Number: 4,538,303

[45] Date of Patent: Sep. 3, 1985

[54] PROTECTIVE HELMET

[75] Inventor: Willibald Schnitzler, Neu-Ulm, Fed. Rep. of Germany

[73] Assignee: Romer GmbH, Neu-Ulm, Fed. Rep. of Germany

[21] Appl. No.: 518,358

[22] Filed: Jul. 29, 1983

[30] Foreign Application Priority Data

Oct. 23, 1982 [DE] Fed. Rep. of Germany ..... 8229801

[51] Int. Cl.[3] ..... A63B 71/10

[52] U.S. Cl. ..... 2/424; 2/425; 2/435

[58] Field of Search ..... 2/424, 425, 427, 410, 2/171.3, 6, 9, 435

[56] References Cited

U.S. PATENT DOCUMENTS

| | | | |
|---|---|---|---|
| 3,116,488 | 1/1964 | Zbikowski | 2/418 |
| 3,116,490 | 1/1964 | Zbikowski | 2/414 |
| 3,245,087 | 4/1966 | Marchello | 2/422 |
| 3,444,288 | 5/1969 | Mead | 264/161 |
| 3,444,433 | 10/1967 | Stapenhill | 2/420 |
| 3,466,219 | 9/1969 | Schwartz | 428/68 |
| 3,491,055 | 1/1970 | Talley | 523/200 |
| 3,496,854 | 2/1970 | Feldmann et al. | 2/410 X |
| 3,661,662 | 5/1972 | Allen | 156/62.2 |
| 3,700,535 | 10/1972 | McCoy et al. | 428/367 |
| 3,711,864 | 1/1973 | Dickstein | 2/416 |
| 3,763,494 | 10/1973 | Nordskog | 2/421 |
| 3,769,144 | 10/1973 | Economy et al. | 428/225 |
| 3,783,450 | 1/1974 | O'Commor | 2/425 |
| 3,788,935 | 1/1974 | Shyne et al. | 428/293 |
| 3,825,469 | 6/1974 | Economy et al. | 428/366 |
| 3,879,761 | 4/1975 | Bothwell | 2/415 |
| 3,906,546 | 9/1975 | Gooding | 2/414 |
| 3,914,494 | 10/1975 | Park | 428/247 |
| 3,925,821 | 12/1975 | Lewicki | 2/425 |
| 4,081,865 | 4/1978 | Bergee et al. | 2/425 |
| 4,115,874 | 9/1978 | Hasegawa | 2/425 |
| 4,290,150 | 9/1981 | Guerre-Berthelot | 2/424 X |
| 4,354,285 | 10/1982 | Rudd | 2/424 |
| 4,446,576 | 5/1984 | Hisataka | 2/425 |

FOREIGN PATENT DOCUMENTS

| | | | |
|---|---|---|---|
| 74084 | 4/1894 | Fed. Rep. of Germany . | |
| 566178 | 12/1932 | Fed. Rep. of Germany . | |
| 688965 | 2/1940 | Fed. Rep. of Germany . | |
| 2050297 | 4/1971 | Fed. Rep. of Germany . | |
| 2344821 | 10/1974 | Fed. Rep. of Germany . | |
| 2639185 | 3/1977 | Fed. Rep. of Germany . | |
| 1456824 | 11/1976 | United Kingdom | 2/410 |
| 1576410 | 10/1980 | United Kingdom | 2/410 |
| 1576647 | 10/1980 | United Kingdom | 2/435 |
| 2046080 | 11/1980 | United Kingdom | 2/424 |
| 2048056 | 12/1980 | United Kingdom | 2/410 |

*Primary Examiner*—Werner H. Schroeder
*Assistant Examiner*—J. L. Kravitz
*Attorney, Agent, or Firm*—Karl F. Ross; Herbert Dubno

[57] ABSTRACT

A protective helmet, e.g. a motorcycle helmet has a chinpiece below its visor which defines an air passage with a member behind this chinpiece, permitting air to flow from an opening in this chinpiece uniformly over the interior of a visor to prevent fogging thereof by moisture.

12 Claims, 6 Drawing Figures

PROTECTIVE HELMET

FIELD OF THE INVENTION

The present invention relates to a protective helmet, and more particularly, to a cyclist's helmet and more generally to a helmet designed to enclose the head and face of a user to provide protection against shocks or impacts, especially those resulting from high-speed travel. The helmet of the type with which the invention is concerned generally comprises a hard impact-resistant shell which can be formed with a chinpiece, i.e. a bar or band of the same material extending across the chin or mouth regions of the user, and provided with an opening which can be covered or closed by a visor and through which the cyclist or other sportsman can view the path before him or his surroundings. Such shells are generally lined with a padding or cushioning material.

BACKGROUND OF THE INVENTION

Protective helmets of the aforedescribed type are known for a variety of uses and in many configurations, sizes, and structural organizations.

For example, they may be used by motorcyclists and even bicyclists, by others engaged in racing sports and, indeed wherever there is a danger that the user may be thrown from his perch on a vehicle or other traveling object, and wherever the speed of travel or the environment is such as to require the use of a visored helmet.

In summary, the basic elements of such a helmet are the impact-resistant shell which can be composed, at least in part, of an impact-resistant synthetic resin or plastic material, possibly reinforced, e.g. with fiberglass or other filaments, generally of a uniform thickness and shaped to enclose substantially all of the head above the chin of the user. This shell can be provided with a window which can be covered by a movable or immovable visor which is transparent to allow the user to see through the window and yet be protected from the elements.

The bottom of the window is generally delimited by the chinpiece previously described, which can be a separate element, or is formed unitarily with the shell, and practically all of the inwardly turned surfaces of the shell can be lined with a padding designed to absorb shocks and generally formed from a foamed synthetic resin material. Edges of the shell may be further cushioned by more dense padding materials or linings so as to eliminate exposed sharp edges.

It has long been recognized that it is desirable to provide ventilation for such helmets. Typical of the publications, patents and other literature describing such helmets are the references listed below:

U.S. Pat. Nos. 3,925,821; 3,788,935; 3,763,494; 3,661,662; 3,914,494; 3,783,450; 3,711,864; 3,491,055; 1,456,824; 3,906,546; 3,769,144; 3,700,535; 3,344,433; 3,825,469; 4,081,865; 3,245,087; 3,116,488; 3,466,219; 3,444,288; 3,116,490; 3,496,854.

English Pat. No. 1,456,824, German patents or patent publications No. 20 50 297, No. 23 44 821, No. 26 39 185, No. 74 084, No. 566,178, and No. 688,965.

The conventional helmets of this type have openings at various places on the shell or other means through which fresh air for ventilating the space between the head and the shell and the space between the face and the visor can enter. They also may have openings through which the ventilating air may leave and, in some cases, are provided with shutters or the like for the controlling airflow. Specifically, the air may be caused to pass between the padding above and around the scalp, i.e. above and around the parietal, temporal and occipital regions of the head, and the shell, e.g. through passages defined between the padding and the shell.

It has been found, however, that with such prior art systems insufficient airflow is directed over the visor and especially over the surface of the visor immediately juxtaposed with the nose and mouth of the user to prevent clouding or fogging of the visor by the breath of the user. As a consequence, the visor may become obscured and result in danger to the user.

Furthermore, the region of the chinpiece generally encompasses a portion of the neck of the user and experience has shown that this region is insufficiently ventilated or cooled so that the skin can be overheated in the region of the neck or throat utilizing conventional helmets designed to enclose the entire head.

OBJECTS OF THE INVENTION

It is, therefore, the principal object of the present invention to provide a protective helmet in which the ventilation is improved to avoid the disadvantages described above.

A more specific object of this invention is to provide a helmet with improved ventilation in the throat and visor region so that overheating of the neck can be eliminated and, at the same time freedom from clouding or fogging of the visor can be insured.

It is yet another object of this invention to provide a helmet of the type described which has more uniform and improved ventilation than the prior art helmets.

SUMMARY OF THE INVENTION

These objects and others which will become apparent hereinafter are attained, in accordance with the invention, in a protective helmet having a shell, visor and chinpiece below the window which can be closed by the visor and wherein this chinpiece is formed with at least one inlet for ventilating air and inwardly of the chinpiece, a shaped element is provided to define a plenum receiving this air and distributing it upwardly along the visor. In other words, within the shell, the inlet or opening in the chinpiece is covered by a shaped member which defines passages conducting the air upwardly to the visor. This shaped member can be a piece of padding which itself can be integrally provided with formations maintaining the aforementioned passages, or a rigid member defining these passages with the rigid chinpiece and in turn lined by a padding in the regions thereof juxtaposed with the face of the wearer.

The combination of a plenum chamber and passages directed upwardly onto the visor insures that the airstream will be spread uniformly over the entire width of the visor and will provide a uniform freedom from clouding or removal of moisture which may have condensed upon the inner surface of the visor.

Since there is no significant suction in this region, a strong suction stream which may disturb the visibility of the user is also eliminated.

If desired, the air after flowing across the visor can be conducted by the conventional means previously described, along the top of the shell to contribute to the overall cooling and ventilation thereof.

According to a feature of the invention, the shaped member can have a lower edge, i.e. an edge opposite that juxtaposed with the visor, adapted to grip or engage an edge of the shell, thereby insuring that practically all of the air which enters the chamber through the opening will be diverted to pass over the visor.

According to another feature of the invention, the shaped member can have one or more projections on its surface turned toward the chinpiece of the shell to form spacers defining the chamber and the passages by maintaining a gap between this member and the chinpiece.

These spacers or projections, moreover, can serve to transmit force from the padding to the shell and vice versa, and can contribute to shock absorption in the case of need.

Thus the spacers or projections not only assist in defining the optimum flow cross sections for the passages but also facilitate the distribution of the airstream and provide a cushioning role.

It has been found to be advantageous to provide the shaped member with tongues receivable in slots of the shell or to provide a tongue-and-groove connection between the shaped member and the shell to facilitate removal of the shaped member, e.g. for cleaning.

According to another feature of the invention, the upper visor-facing edge of the shaped member is provided with a spoiler-like bent portion, turned toward the visor and deflecting the sheet-like stream of air thereagainst. This deflector further improves the flow characteristics so that there is little or no flow of air directed toward the eyes of the wearer, i.e. the flow is directed away from the face of the user toward the visor.

This has an advantage, even when the visor is lifted in that an outwardly directed air current is established which intersects the incoming airflow and directs it upwardly over the helmet or over the head of the wearer, and limits the penetration of air through the visor into the helmet.

Still a further improvement in the flow is obtained when the upper surface of the shaped member turned toward the shell is provided with a generally aerodynamically designed shape to reduce turbulence.

To permit adjustment of the helmet to a particular wearer, the shaped member can be constituted from two overlapping mutually adjustable elements. For example, a double-wall element can receive the upper element, provided with the spoiler between its two walls which can be clamped together to retain the upper element in a friction grip. The lower edge can also be provided with a groove to receive a wind deflector or shield.

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
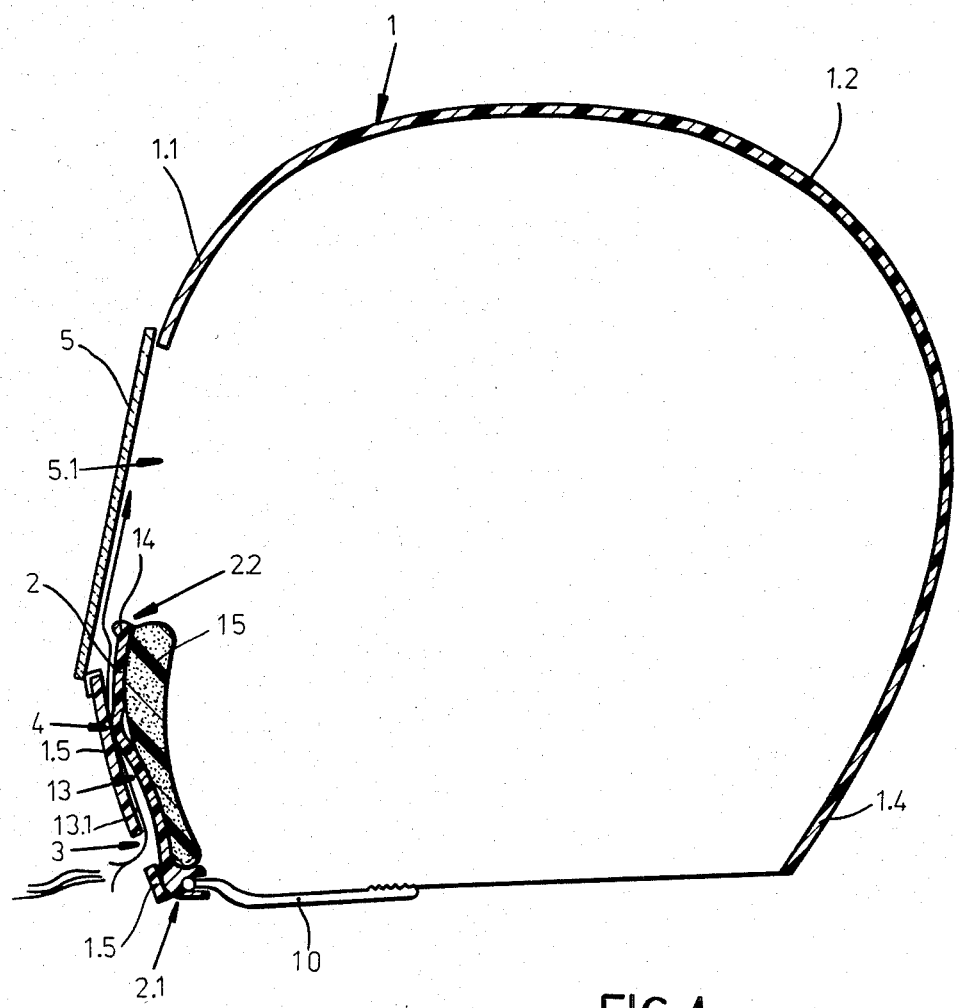
FIG. 1 is a diagrammatic vertical section through a helmet according to the invention in which the protective padding for the upper and lateral portions has been omitted.

In the drawing, I have shown a helmet which comprises a helmet shell 1 which has a frontal portion 1.1, an occipital portion 1.2, temporal portions 1.3 (FIG. 2) and a portion 1.4 approaching the nape of the neck. This shell is provided with a window 5.1 delimited below by a chinpiece 1.5 which can be covered by a visor 5. The visor 5, composed, for example, of a transparent acrylic polymer, is pivoted in any conventional way at 5.2 on the temporal portions of the shell so that it can be swung upwardly and preferably can be arrested in its upper position to open the window 5.1.

Figure 2:
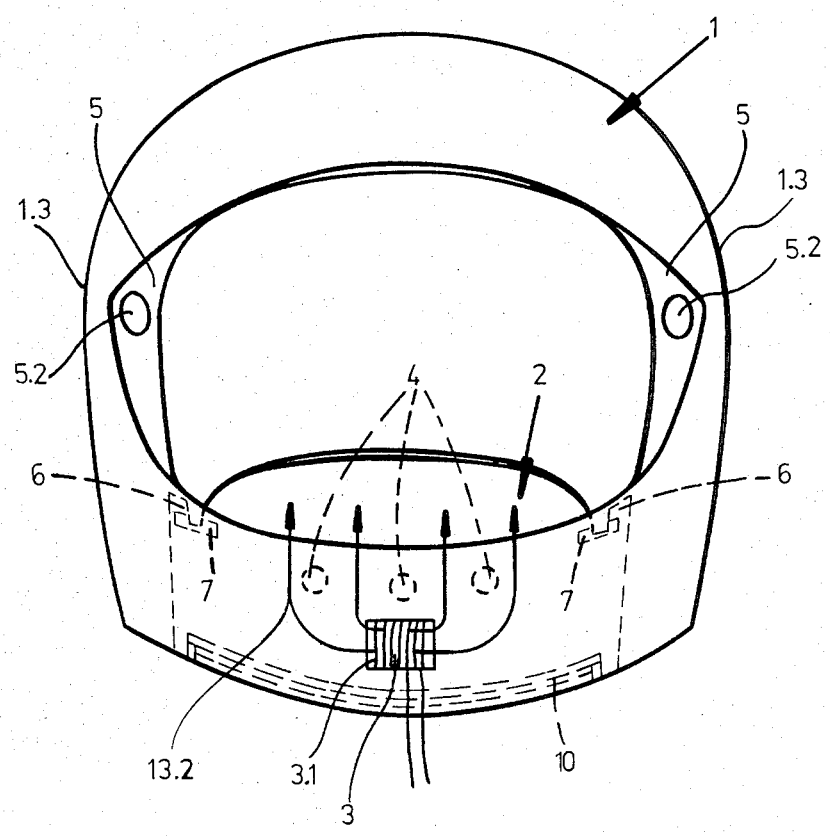
FIG. 2 is a front view of the helmet.

The chinpiece 1.5 is provided with an opening 3 forming an inlet for the air, this inlet being covered by a grill 3.1 shown in FIG. 2. If desired, this opening can also be provided with a slide shutter arrangement forming a valve which controls the admission of the ventilating air through the opening 3.

The inner face of the chinpiece 1.5 is covered by a shaped member represented generally at 2 and lined, if desired, with a padding 15. While in the embodiment shown the member 2 is a resilient relatively stiff element which can be composed of impact-resistant plastic such as the plastic or synthetic resin constituting the shell, it can also form part of a padding, i.e. the outer wall of a cushion filled with a foamed material, if desired.

This shaped member defines a plenum chamber 13.1 which extends as a manifold into passages 13 directing the air upwardly as represented by the arrows 13.2 in FIG. 2, for example.

Figure 3:
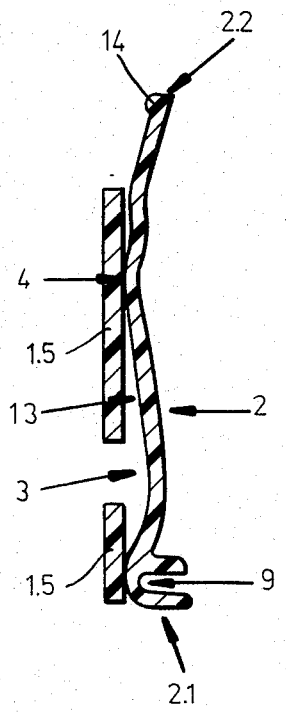
FIG. 3 is a detail section, drawn to a larger scale, of a shaped member defining the passages in accordance with the invention.
Figure 4:
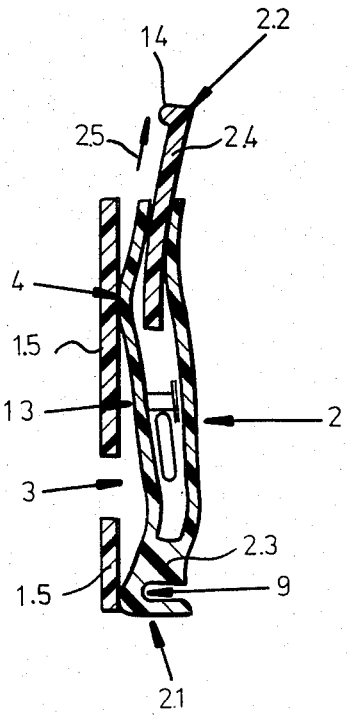
FIG. 4 is a similar view showing an adjustable shaped member according to the invention.
Figure 5:
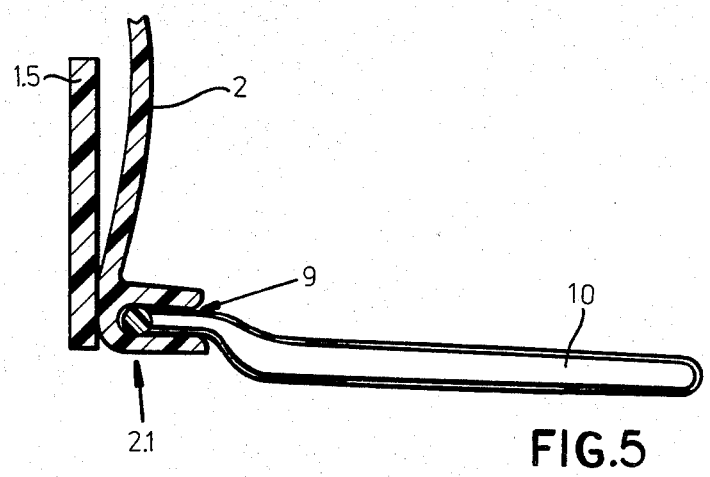
FIG. 5 is a detail sectional view, also to a larger scale, showing the wind deflector in place.

The lower edge of the shaped member 2 at its region 2.1 turned toward the shell rests thereagainst with a bead as shown at the lower left-hand portion of FIG. 1 and in each of FIGS. 3, 4 and 5.

Above the plenum, the member 2 is provided with projections 4 which are horizontally spaced apart (see FIG. 2) and also bear against the chinpiece 1.5 to define the passages 13 between them.

The upper portion 2.2 projects above the upper edge of the chinpiece to assist in deflecting the air outwardly against the visor.

Member 2 is provided with tongues 6 which engage in slits 7 of the shell 1 (FIG. 2) thereby retaining the member 2 removably in place.

The upper edge 2.2 of the member 2 is provided with a ridge or other formation bent as a spoiler toward the visor to assist in deflecting the air thereagainst. In addition, at least the surface of member 2 encountered by the airstream has an aerodynamic shape to reduce turbulence.

The member 2 as shown in FIG. 3, is formed in one piece whereas the corresponding member in FIG. 4 is constituted of two parts 2.3 and 2.4. The lower part 2.3 is of double-wall construction and clamps the upper part 2.4 between its two walls to allow height adjustment in the direction of arrow 2.5 of the upper edge at which the air is deflected onto the inner surface of the visor according to the individual requirements of the user.

Figure 6:
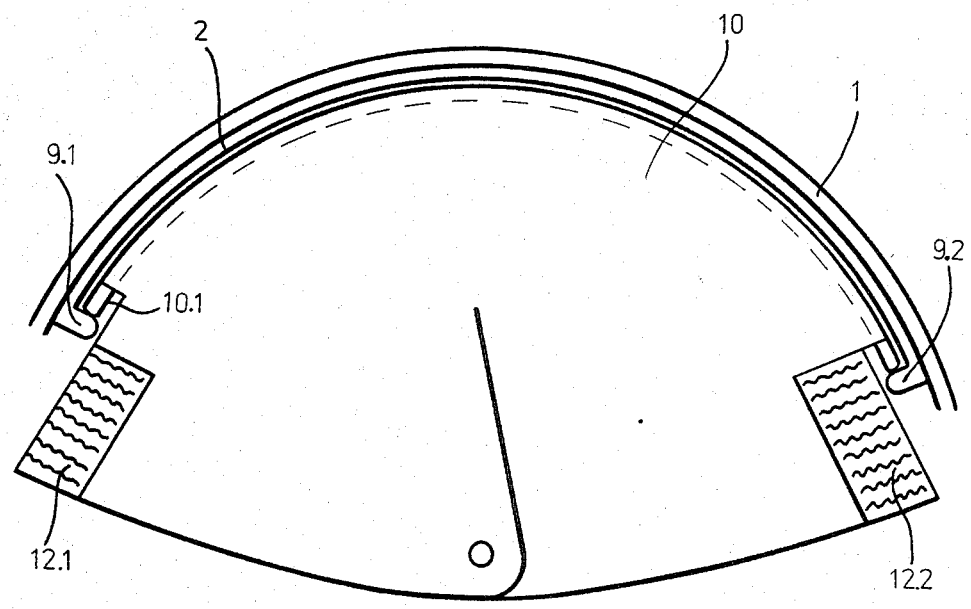
FIG. 6 is a bottom view illustrating the wind deflector in place.

The lower edge 2.1 is provided with a receiving groove 9 which, as shown in FIGS. 5 and 6, can receive the bead of a wind deflector or shield 10. To retain this bead, the groove is terminated by projections 9.1 and 9.2 between which the bead 10.1 is stressed to remain bowed outwardly. The fabric of the windshield can be looped over the bead and VELCRO type or other fastening means can be provided at 12.1, 12.2 to permit connection of the shield fabric to the cushion or lining (not shown) of the shell.

I claim:

1. A protective helmet comprising:

an impact-resistant shell adapted to substantially fully enclose the head of a user and including a chinpiece having upper and lower edges, said shell being formed with a window frontwardly of the location at which the face of a user would be disposed upon wearing of the helmet, with said upper edge of said chinpiece defining the lower boundary of said window;

a visor mounted on said shell for closing said window;

at least one air inlet opening formed in said chinpiece; and a shaped member in said shell lying along and rearwardly of said chinpiece, said member and said chinpiece being spaced from each other to define therebetween at least one upwardly open passage for air entering through said air inlet opening to flow along, said member having its frontwardly directed surface shaped to guide said air and direct it, upon leaving said passage, upwardly and substantially uniformly over the rearwardly directed surface of said visor over the full expanse of said window for inhibiting fogging of said visor.

2. The protective helmet defined in claim 1 wherein said member has a lower edge bearing against said lower edge of said chinpiece.

3. The protective helmet defined in claim 2 wherein said member is provided with at least one projection extending therefrom in the direction of said chinpiece and bearing against the latter, to interrupt the space between a portion of said member and said chinpiece at the location of said projection and thereby to form a plurality of passages between said member and said chinpiece.

4. The protective helmet defined in claim 3 wherein said member is provided with a plurality of said projections spaced laterally of each other across the width of said member.

5. The protective helmet defined in claim 1 wherein said member is provided with tongues receivable in slits formed in said shell for removably mounting said member on said shell.

6. The protective helmet defined in claim 1 wherein said member has an upper edge projecting above said upper edge of said chinpiece and formed with a spoiler-like bend toward said visor for deflecting air thereover.

7. The protective helmet as defined in claim 1 wherein said member has over at least a portion of its frontward surface directed toward said chinpiece, an aerodynamic shape.

8. The protective helmet defined in claim 1 wherein said member has an upper edge and is constituted of two mutually overlapping and relatively shiftable elements enabling adjustment of the upper edge of said member relative to said chinpiece.

9. The protective helmet defined in claim 7 wherein one of said elements is of double-wall construction and clampingly receives the other element between the walls thereof.

10. The protective helmet defined in claim 1 wherein said member has a lower edge provided with a groove adapted to receive a bead of a windshield.

11. The protective helmet defined in claim 1 wherein said member is padded.

12. The protective helmet defined in claim 1 wherein said member defines with said chinpiece ~~a plenum~~ from which said passages extend upwardly.

* * * * *